United States Patent [19]

Finger

[11] 4,095,563

[45] Jun. 20, 1978

[54] LOW PRESSURE STEAM GENERATOR

[75] Inventor: John F. Finger, Beresford, S. Dak.

[73] Assignee: Sioux Steam Cleaner Corporation, Beresford, S. Dak.

[21] Appl. No.: 747,356

[22] Filed: Dec. 3, 1976

[51] Int. Cl.[2] ..... F22B 21/30

[52] U.S. Cl. ..... 122/235 R; 122/276; 122/328

[58] Field of Search ..... 122/235 R, 248, 276, 122/328

[56] References Cited

U.S. PATENT DOCUMENTS

| | | | |
|---|---|---|---|
| 3,257,992 | 6/1966 | Bishop | 122/328 |
| 3,962,999 | 6/1976 | Rehm | 122/248 |
| 3,970,048 | 6/1976 | Finger et al. | 122/276 |

FOREIGN PATENT DOCUMENTS

| | | | |
|---|---|---|---|
| 72,255 | 4/1953 | Netherlands | 122/248 |

*Primary Examiner*—Kenneth W. Sprague

*Attorney, Agent, or Firm*—Merchant, Gould, Smith, Edell, Welter & Schmidt

[57] ABSTRACT

A low pressure steam generator comprising a horizontal coil of tubing having a single upper steam outlet header and a pair of lower water inlet headers on opposite sides of the coil. Curved taps connect the successive turns of the coil with the steam header, and curved taps connect the water headers alternately to the coil turns to give a structure which is resistant to differential thermal expansion and which is minimally susceptible to surging, pressure variation, and entrainment of water in the steam input.

11 Claims, 8 Drawing Figures

LOW PRESSURE STEAM GENERATOR

BACKGROUND OF THE INVENTION

This invention relates to the field of steam engineering, and particularly to apparatus for generating low pressure steam for uses such as soil sterilization and wallpaper removal. It constitutes an improvement on a structure shown in U.S. Pat. No. 3,970,048, from which it differs however in several respects.

SUMMARY OF THE INVENTION

The improved invention comprises a tightly wound horizontal coil of tubing into which a flame is projected, as before, with an ouput header above the coil and running parallel to its axis. There are two angularly spaced inlet headers below the coil here, the housing is close fitting to the coil except at the locations of the headers, a shield plate is interposed within the coil to prevent contact of the flame directly with the upper portions of the coil turns which do not contain water, and the water supply and steam outlet are at the opposite end of the assembly from that where the flame is projected. These features combine to give a steam generator which is less prone to pulsations of pressure and which has less carrying of hot water into the steam channels than heretofore, although I am not at present able to indicate the relative importance of these different factors in producing the improved performance.

Various advantages and features of novelty which characterize my invention are pointed out with particularity in the claims annexed hereto and forming a part hereof. However, for a better understanding of the invention, its advantages, and objects attained by its use, reference should be had to the drawings which form a further part hereof, and to the accompanying descriptive matter, in which there is illustrated and described a preferred embodiment of the invention.

DESCRIPTION OF THE PREFERRED EMBODIMENT

Figure 1:
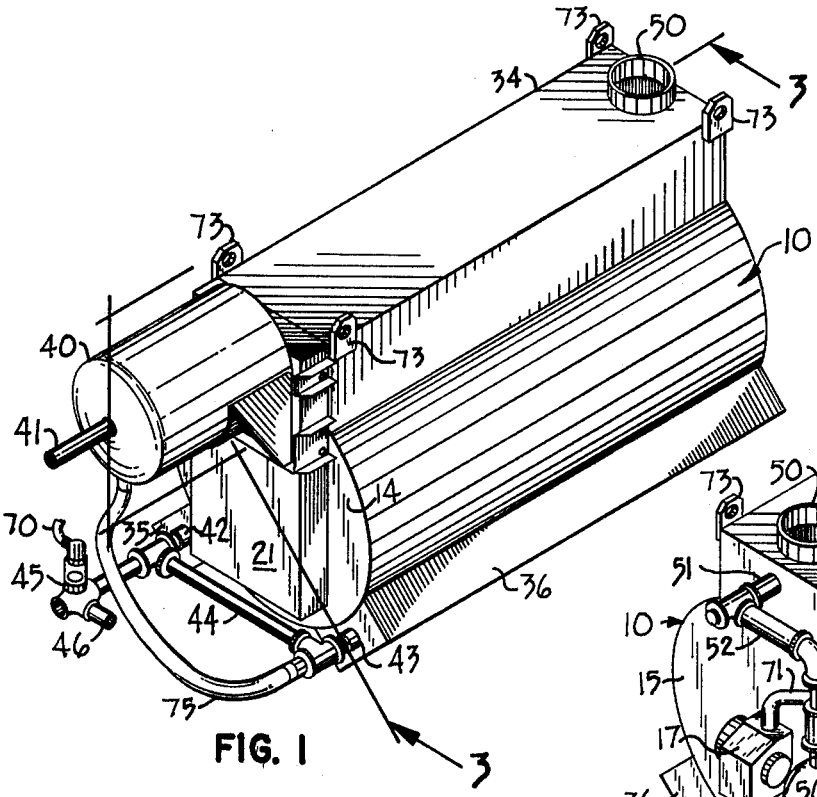
FIG. 1 is a general isometric view of my improved generator.
Figure 2:
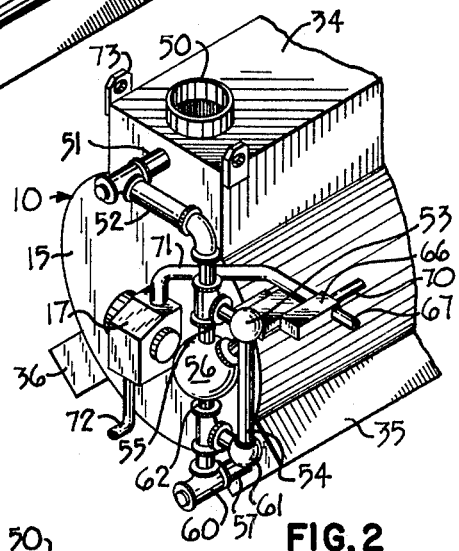
FIG. 2 is a similar view of the end of the generator not shown in FIG. 1.

The invention is shown to comprise a housing 10 surrounding a coil 11 of tubing, tightly wound to leave minimum space between successive turns. The coil is closed at both ends 12, and is carried on circular bands 13 projecting inwardly from a pair of end plates 14 and 15 of housing 10. A rectangular opening 16 is provided in end plate 14, and end plate 15 carries a burner 17 for projecting a heating flame 20 forward into the coil. The products of combustion pass out through opening 16 and up a stack 21 secured to end plate 14.

Figure 3:
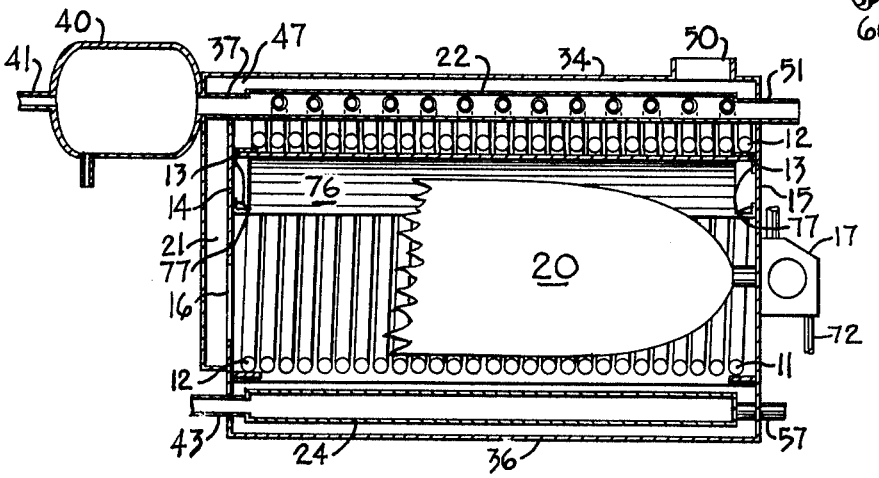
FIG. 3 is a longitudinal sectional view of the invention taken along the broken line 3—3 of FIG. 1.
Figure 4:
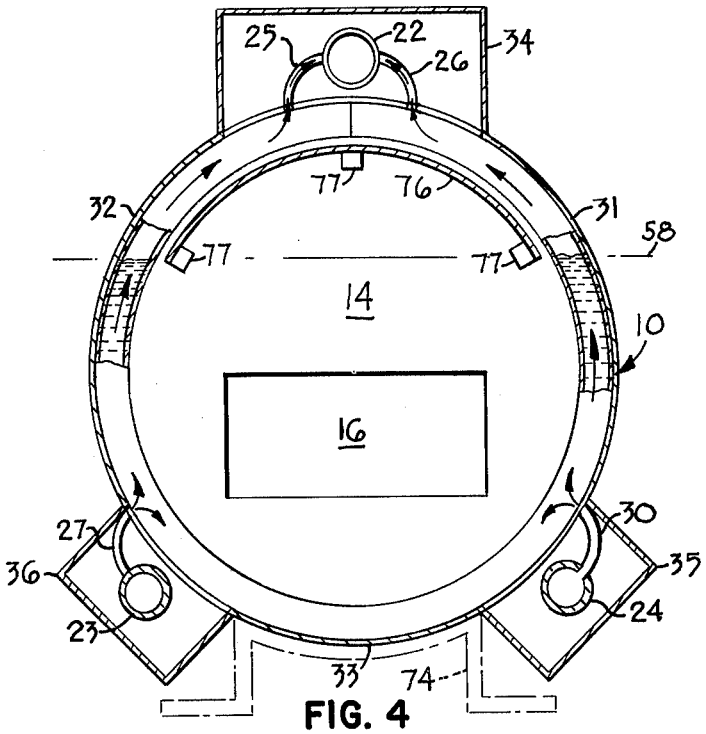
FIG. 4 is a view of the generator seen from the burner end, parts including the end of the housing being removed for clarity of illustration.

As shown in FIGS. 3 and 4 an outlet header 22 and pair of inlet headers 23 and 24 extend along coil 11 and are spaced slightly outwardly from it. The angles around the axis of the coil from header 22 to headers 23 and 24 are about 135°. Taps 25 and 26 of reduced diameter extend outwardly and curve downwardly from header 22 to successive turns of coil 11, near its top, and taps 27 and 30 of reduced diameter extend upwardly and curve inwardly from headers 23 and 24 respectively, to alternate turns of the coil below its center. Housing 10 is built up around coiling 11 in the form of three cylindrical sections, 31, 32 and 33 secured to end plates 14 and 15, and three header covers 34, 35 and 36 secured to end plates 14 and 15 and to sections 31, 32 and 33.

The fact that taps 25, 26, 27 and 30 are curved rather than straight results in a structure which is resistant to damage by differential thermal expansion.

A conduit 37 extends from header 22 through one end of cover 34 to a steam pressure cylinder 40, from which the outlet of the generator is taken at a conduit 41. At the same end of the generator, conduits 42 and 43 extend from headers 23 and 24 through the ends of covers 35 and 36, all respectively, and are connected by suitable piping 44 to a normally closed solenoid valve 45 which controls the passage of water to the inlet headers from a supply conduit 46.

The upper end of stack 21 opens into cover 34 at 47, so that combustion products from burner 17 flow backward around header 22 and taps 25 and 26, finally leaving the generator through a flue 50. A conduit 51 extends from the end of header 22 next to burner 17 outward through cover 34, and is connected by suitable piping 52 with the upper fitting 53 of a gauge glass 54 and with the upper input 55 of a water level control 56, the level maintained being indicated by the broken horizontal line 58. A conduit 57 extends from the end of header 23 next to burner 17 outward through cover 35, and is connected by suitable piping 60 with the lower fitting 61 of gauge glass 54 and with the lower input 62 of control 56.

Figure 5:
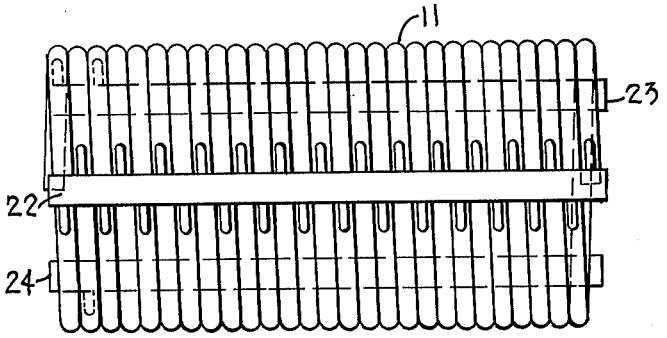
FIGS. 5 and 6 are top and bottom views of a coil used in the invention.
Figure 6:
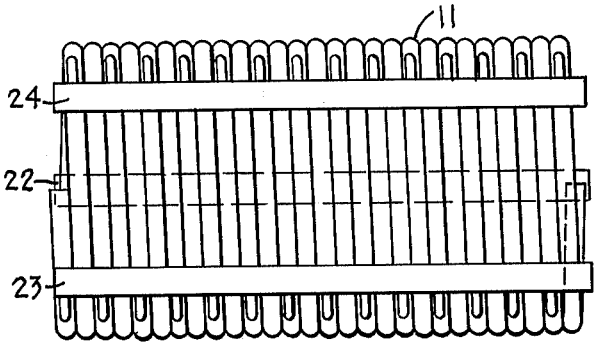
Figure 7:
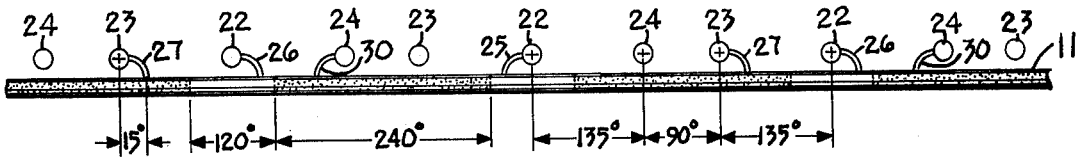
FIG. 7 is a fragmentary developed view of a portion of the invention to show the spacial relationships of certain taps along the coil.

FIGS. 5–7 show coil 11 and elements 23–30 in relation thereto as used in one successful embodiment of the invention. The water level is shown to be at locations 60° from the site of header 22, and angular displacements of about 15° exist between the headers and the sites of the taps along the coil. At the burner end the coil is closed at the top, at a site in line with header 22, and at the other end the coil is closed at the bottom, at a site midway between headers 23 and 24.

Consideration of FIG. 7 will make it clear that in use the header comprises a plurality of partially filled chambers which are connected to a common steam outlet, but are essentially independent as regards water supply and water content. Boiling in these mutually isolated chambers can take place at fortuitiously different rates in accordance with micro conditions along the coil, the variations being contained and localized to reduce any overall surging or other effect of unwelcome magnitude, and hence, to minimize pressure variations and liquid entrainment. The relatively large volume of water in the path from a given coil turn-through for example, tap 30, header 24, piping 44, tap 27, and header 23-to the next adjoining coil turn is believed to contribute materially to the success of this arrangement.

The end of header 24 nearest burner 17 is closed.

Figure 8:
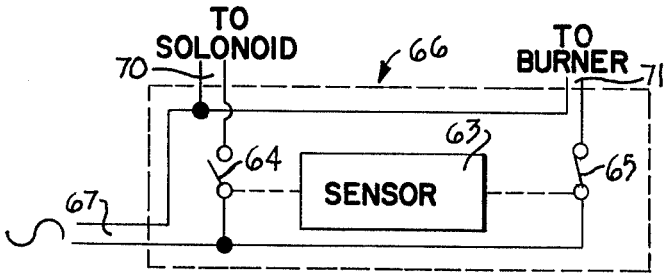
FIG. 8 is a wiring schematic of the invention.

Control 56, as is shown in FIG. 8, comprises a sensor 63 operated by changes in the level of liquid in the turns of the coil to actuate a first single pole single throw switch 64 from an open position into a closed position when the liquid level drops below a first predetermined point and to actuate a second single pole single throw switch 65 from a closed position into an open position if the liquid level drops still further to a second predetermined point. The control includes a junction box 66 to which electrical energy from a suitable source is provided on a cable 67. Switch 64 controls the operation of solenoid valve 45 through a cable 67. Switch 64 controls the operation of solenoid valve 45 through a cable 70, and switch 65 controls the operation of burner 17 through a cable 71. Burner fuel is supplied through a conduit 72.

For convenience in handling, housing 10 is shown as being provided with a plurality of lifting ears 73, and it can be mounted, as indicated in FIG. 4, on any suitable saddle 74. A condensate return 75 is shown connecting cylinder 40 to piping 44 near conduit 43. A stainless steel shield 76 is mounted within coil 11 by tabs 77 secured to end plates 14 and 15, to prevent direct contact of flame 20 with portions of coil 11 not containing water. If the generator is to be used for soil sterilization, for example, saddle 74 may be mounted on a suitable wheeled vehicle, not shown, which may also carry a suitable fuel tank for burner 17. In such a case water may be supplied to conduit 46 by a long hose or from a tank vehicle, and electrical energy may similarly be supplied to cable 67 on a long extension cord or from a portable electric generator. These conventional details are not shown in the drawing.

OPERATION

In operation the generator is connected to a source of water at 46, to a source of burner fuel at 72, and to a source of electrical energy at 67. Initially, switch 64 is closed and switch 65 is open. As the level of water rises, sensor 63 closes switch 65, starting burner 17 through a conventional ignition circuit not shown. As is shown in FIG. 8, when the water reaches the operative level, switch 64 is opened, allowing valve 45 to close. Continued operation of the burner heats the coil by radiation and conduction, except where shield 76 prevents actual contact of the coil with the flame: here the heating is by radiation from the heated shield. Steam generated in the lower portion of the coil rises into the top of the coil and passes to header 22, the steam being somewhat dried in the area above shield 76. By reason of the structure of coil 11, header 22 and taps 25 and 26, a minimum of liquid water is carried into header 22 as a result of surges in the coil. Water condensed in header 22 and pressure cylinder 40 is returned to the inlet through conduit 75.

When the water level drops sufficiently sensor 63 closes switch 64, and valve 45 is opened to refill the coil. It is customary to design generators of this sort with the burner capacity so chosen that the burner may run continuously, without need for any thermostatic or pressure responsive control, although of course, they may be added if necessary. If the water supply fails, the level in coil 11 drops until sensor 63 opens switch 65, shutting off burner 17.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. In combination:
a coil of tubing closed at both ends and helical about an axis;
a first header outside of and adjacent to said coil and extending parallel to said axis;
first taps connecting said first header to successive turns of said coil;
a pair of further headers outside of and adjacent to said coil and extending parallel to said axis at locations angularly spaced oppositely about said axis from the radius of the helix passing passing through the location of said first header;
and second taps extending from successive turns of said coil to alternate ones of said pair of headers at sites spaced oppositely about said axis by predetermined obtuse angles from the radius of the helix passing through the location of said first header,
so that each turn of said coil has a connection to said first header, and a connection to only one of said pair of headers, spaced by less than 180° around said axis.

2. The structure of claim 1 in which said taps are curved in configuration.

3. A structure according to claim 1 in which said first taps curve from opposite sides of said first header to successive turns of said coils at sites spaced oppositely about said axis by acute angles from the radius of the helix passing through the location of said first header.

4. A structure according to claim 3 in which said first angles are substantially equal, and in which said second angles are also substantially equal and are much greater than said first angles, so that each turn of said coil has a connection to said first header and a connection to one of said pair of headers on the same side of the plane determined by said axis and said radius.

5. A structure according to claim 4 in which said first angles are less than 30° and said second angles are greater than 90°.

6. A structure according to claim 1, and means in addition to said coil and said taps providing a passage for liquid between said further headers.

7. A structure according to claim 1 in which first ends of said further headers extend axially beyond an end of said coil, and means interconnecting said first ends of said further headers.

8. A steam generator comprising, in combination:
a close wound coil of tubing closed at both ends and helical about a horizontal axis;
an outlet header outside of and adjacent to said coil and extending above and parallel to said axis;
first taps curving downward from said outlet header to sites on successive turns of said coils spaced by acute angles from the radius of the helix passing through the location of said header;
a pair of inlet headers outside of and adjacent to said coil and extending below and parallel to said axis at locations which are spaced oppositely about said axis by obtuse angles from said radius;
second taps curving downwardly from the lower portions of successive turns of said coil to alternate ones of said inlet headers, so that each of said turns has a connection to said outlet header, and a connection to one only of said inlet headers, spaced by less than 180° around said axis;

means in addition to said coil and said taps for providing a passage for liquid between said further headers;

means for supplying water for said generator to said inlet headers;

means for supplying heat to said coil;

means for maintaining the water level at a predetermined height in said turns below the top thereof;

and means for withdrawing steam from said outlet header.

9. In a structure according to claim 8, wherein the means supplying heat to said coil comprises a burner projecting a flame axially into said coil, in combination:

a housing enclosing said headers and closely surrounding said coil between said headers;

and means directing the hot products of combustion to flow between said housing and said coil over said outlet header and the taps extending downward therefrom, in a direction opposite to the direction of projection of said flame.

10. A steam generator comprising, in combination:

a close wound coil of tubing closed at both ends and helical about a horizontal axis;

an outlet header outside of and adjacent to said coil and extending above and parallel to said axis;

first taps curving downward from opposite sides of said outlet header alternately to sites on successive turns of said coil which are spaced oppositely about said axis by small first angles from the radius of the helix passing through the location of said header;

a pair of inlet headers outside of and adjacent to said coil and extending below and parallel to said axis at locations which are spaced oppositely about said axis by large second angles from said first header, first ends of said inlet headers extending axially beyond a first end of said coil;

second taps curving downwardly from lower portions of successive turns of said coil to alternate ones of said inlet headers so that each of said turns has a connection to said outlet header and a connection to one only of said inlet headers, both of said connections lying on the same side of a plane determined by said axis and said radius;

means interconnecting said first ends of said inlet headers;

means for projecting a flame into said coil from the second end thereof;

means for preventing direct contact of said flame with portions of said turns above the level of water therein;

means for supplying water at said first ends of said inlet headers;

means for maintaining the water level at a predetermined height in said turns below said first taps and about said second taps;

and means for withdrawing steam from said outlet header at the first end of the coil.

11. A steam generator comprising, in combination:

a close wound coil of tubing closed at both ends and helical about a horizontal axis;

an outlet header above and adjacent to said coil and extending parallel to said axis;

taps curving downward from said outlet header to sites on successive turns of said coils spaced by acute angles from the radius of said helix passing through the location of said header;

a pair of inlet headers outside of and adjacent to said coil and extending parallel to said axis at locations which are spaced oppositely about said axis by obtuse angles from said radius;

taps curving downwardly from the lower portions of successive turns of said coil to alternate ones of said inlet headers, so that each of said turns has a connection to said outlet header and a connection to one of said inlet headers;

means for supplying heat to said coil, comprising a burner projecting a flame axially into said coil;

a housing enclosing said headers and closely surrounding said coil between said headers;

means directing the hot products of combustion to flow between said housing and said coil over said outlet header and the taps extending downwardly therefrom, in a direction opposite the direction of projection of said flame;

means for maintaining the water level at a predetermined height in said turn below the top thereof;

means for withdrawing steam from said outlet header;

and means preventing direct contact of said flame with the portions of said turns above the predetermined height of said water.

* * * * *